US012222153B2

(12) United States Patent
Miao et al.

(10) Patent No.: US 12,222,153 B2
(45) Date of Patent: Feb. 11, 2025

(54) AIR-COOLED REFRIGERATOR

(71) Applicants: QINGDAO HAIER REFRIGERATOR CO., LTD., Shandong (CN); HAIER SMART HOME CO., LTD., Shandong (CN)

(72) Inventors: Jianlin Miao, Shandong (CN); Noda Toshinori, Shandong (CN); Bin Fei, Shandong (CN); Chunyang Li, Shandong (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 181 days.

(21) Appl. No.: 18/020,986

(22) PCT Filed: Aug. 11, 2021

(86) PCT No.: PCT/CN2021/112100
§ 371 (c)(1),
(2) Date: Feb. 13, 2023

(87) PCT Pub. No.: WO2022/037459
PCT Pub. Date: Feb. 24, 2022

(65) Prior Publication Data

US 2023/0288126 A1 Sep. 14, 2023

(30) Foreign Application Priority Data

Aug. 18, 2020 (CN) ..... 202010832828.9

(51) Int. Cl.
*F25D 21/14* (2006.01)
*F25D 21/08* (2006.01)
(Continued)

(52) U.S. Cl.
CPC ..... *F25D 21/14* (2013.01); *F25D 21/08* (2013.01); *F25D 23/006* (2013.01);
(Continued)

(58) Field of Classification Search
CPC ..... F25D 21/14; F25D 21/08; F25D 23/006; F25D 23/066; F25D 2321/144; F25D 2321/1441; F25D 11/02
See application file for complete search history.

(56) References Cited

U.S. PATENT DOCUMENTS 3,099,914 A * 8/1963 De Witt ..... F25D 21/14 62/289
3,224,216 A * 12/1965 Crouch ..... F25D 21/14 62/275
(Continued)

FOREIGN PATENT DOCUMENTS

CN 203454542 U 2/2014
CN 109458782 A 3/2019
(Continued)

OTHER PUBLICATIONS

Chinese Intellectual Property Office (ISR/CN), "International Search Report for PCT/CN2021/112100", China, Nov. 3, 2021.
(Continued)

*Primary Examiner* — Joseph F Trpisovsky
(74) *Attorney, Agent, or Firm* — troutman pepper locke; Tim Tingkang Xia, Esq.

(57) ABSTRACT

An air-cooled refrigerator, comprising a bottom liner, an evaporator, a water receiving tray, and a heating wire. A cooling chamber located at the bottom of the bottom liner is defined inside the bottom liner, and the bottom wall of the bottom liner is provided with a water receiving tank with a water drainage outlet at its bottom; the evaporator is provided in the cooling chamber; the water receiving tray is
(Continued)

provided between the evaporator and the bottom wall of the bottom liner to receive water on the evaporator, and a plurality of through holes are formed in a region of the water receiving tray facing towards the water receiving tank; the heating wire is coiled and provided between the water receiving tray and the evaporator to heat and defrost the evaporator, and the heating wire has an extension portion extending to the water receiving tank through the through holes.

10 Claims, 6 Drawing Sheets

(51) Int. Cl.
*F25D 23/00* (2006.01)
*F25D 23/06* (2006.01)

(52) U.S. Cl.
CPC ..... *F25D 23/066* (2013.01); *F25D 2321/144* (2013.01); *F25D 2321/1441* (2013.01)

(56) References Cited

U.S. PATENT DOCUMENTS

| | | | | |
|---|---|---|---|---|
| 2009/0013709 | A1 | 1/2009 | Kim | |
| 2009/0165486 | A1* | 7/2009 | Harlen | F25D 21/08 62/276 |
| 2021/0025640 | A1* | 1/2021 | Richardson | F25D 21/08 |

FOREIGN PATENT DOCUMENTS

| | | | | |
|---|---|---|---|---|
| CN | 109708358 | A | | 5/2019 |
| CN | 209893735 | U | | 1/2020 |
| CN | 209893753 | U | | 1/2020 |
| CN | 210036003 | U | | 2/2020 |
| CN | 110953806 | A | | 4/2020 |
| CN | 210832696 | U | | 6/2020 |
| JP | 2002267332 | A | | 9/2002 |
| KR | 20100043666 | A | * | 4/2010 |
| KR | 20180011691 | A | | 2/2018 |

OTHER PUBLICATIONS

SIPO, "1st CN Office Action and Search Report for CN Application No. 202010832828.9", China.
EPO, "Supplementary European Search Report for EP Application No. 21857554.6", Hague, Germany, Nov. 27, 2023.

* cited by examiner

AIR-COOLED REFRIGERATOR

CROSS-REFERENCE TO RELATED PATENT APPLICATION

This application is a U.S. national stage application of PCT Patent Application No. PCT/CN2021/112100 filed Aug. 11, 2021, which claims priority to and the benefit of Chinese Application No. 202010832828.9 filed Aug. 18, 2020, which are incorporated herein in their entireties by reference.

FIELD OF THE INVENTION

The present invention relates to refrigerating and freezing technologies, and particularly relates to an air-cooled refrigerator.

BACKGROUND OF THE INVENTION

As for a refrigerator with an evaporator at the bottom in the prior art, a cooling chamber is located on the lower portion of the refrigerator, the evaporator is internally provided at the bottom of the cooling chamber, and in order to increase the volume rate and safety of the technology of providing the evaporator at the bottom, a heating wire, e.g., an aluminum tube heating wire, is generally adopted as a defrosting device of the evaporator. However, in order to balance safety and other factors, the temperature of the aluminum tube heating wire will not be set too high, and it may lead to a situation that a fault occurs if large ice blocks a water drainage outlet and cannot be melted in time.

BRIEF DESCRIPTION OF THE INVENTION

One objective of the present invention is to overcome at least one defect in the prior art and to provide an air-cooled refrigerator.

One further objective of the present invention is to prevent a water drainage outlet of a cooling chamber of the refrigerator from being blocked.

Another further objective of the present invention is that as for the air-cooled refrigerator where the cooling chamber is located at the bottom and an evaporator is obliquely provided in the cooling chamber, defrosting water on the evaporator is collected by a water receiving tray to the greatest extent.

Yet another further objective of the present invention is to optimize the shape of a heating wire to make the evaporator heated more evenly.

Particularly, the present invention provides an air-cooled refrigerator, including:

- a bottom liner, internally defining a cooling chamber located at its bottom, a water receiving tank being formed on a bottom wall of the bottom liner, and a water drainage outlet being formed at a bottom of the water receiving tank;
- an evaporator, provided inside the cooling chamber, and configured to cool an air flow entering the cooling chamber to form a cooled air flow;
- a water receiving tray, provided between the evaporator and the bottom wall of the bottom liner, and configured to receive water on the evaporator, a plurality of through holes being formed in a region of the water receiving tray facing towards the water receiving tank; and

- a heating wire, provided between the water receiving tray and the evaporator in a coiled manner, and configured to provide heat for defrosting of the evaporator, the heating wire having an extension portion extending to the water receiving tank through the through holes.

Further, the bottom wall of the bottom liner includes:

- a first oblique portion, obliquely provided downwards from front to back from a front end of the bottom wall of the bottom liner;
- a sunken portion, provided on a rear side of the first oblique portion, and configured to be inclined upwards from a transverse middle to two sides to form the water receiving tank in the transverse middle;
- a second oblique portion, obliquely provided upwards from front to back from a rear end of the water receiving tank; and
- a third oblique portion, obliquely provided upwards from front to back from a rear end of the second oblique portion.

Further, an inclination angle of the third oblique portion is greater than that of the second oblique portion.

Further, the water receiving tray includes:

- a front plate segment, located at a front end of the water receiving tray, with a gap being formed between it and the first oblique portion;
- a middle plate segment, obliquely extending upwards from a rear end of the front plate segment, with its front portion being located above the water receiving tank and provided with the plurality of through holes and its rear portion abutting against the second oblique portion; and
- a rear plate segment, obliquely extending upwards from a rear end of the middle plate segment, and abutting against the third oblique portion;
- the evaporator having an overall flat cuboid shape, and being provided on the middle plate segment, and a bottom of a front end of the evaporator abutting against a junction of the middle plate segment and the front plate segment, such that the evaporator is provided at the inclination angle of the second oblique portion.

Further, a distance between the front plate segment and the first oblique portion is configured as any numerical value within a range from 20 mm to 45 mm.

Further, the heating wire includes:

- a plurality of parallel sections, parallelly provided at intervals relative to a transverse direction of the refrigerator, the extension portion being formed on the parallel sections; and
- a plurality of connection sections, each connection section being provided between ends on a same side of adjacent two parallel sections 410 in a bent extension manner to sequentially connect the plurality of parallel sections in series.

Further, the heating wire also includes:

- an expansion section, a middle portion of the expansion section being provided abutting against the front plate segment and the expansion section extending towards two sides to a position close to a side wall of the bottom liner to conduct defrosting heating on a region in front of the evaporator.

Further, a plurality of limiting parts are provided on positions of a rear portion of an upper surface of the middle plate segment facing towards the plurality of connection sections to limit the connection sections.

Further, a plurality of water drainage holes are also formed in a front portion of the upper surface of the middle plate segment to discharge water received by the water receiving tray into the water receiving tank through the water drainage holes and gaps between the through holes and the extension portion.

Further, a distance between a bottom end of the extension portion and the water drainage outlet is configured as any numerical value within a range from 3 mm to 5 mm.

In the air-cooled refrigerator of the present invention, the water receiving tray is provided between the evaporator and the bottom wall of the bottom liner. The heating wire is provided between the water receiving tray and the evaporator in the coiled manner. The plurality of through holes are formed in the region of the water receiving tray facing towards the water receiving tank. The heating wire has the extension portion extending to the water receiving tank through the through holes. After the extension portion penetrates through the through holes, at least part of the extension portion is provided in the water receiving tank, which may reduce the distance between the heating wire and the water drainage outlet, so that heat of the heating wire can be transferred to the water drainage outlet in time to prevent the impact on the water drainage efficiency due to blocking of the water drainage outlet by large-volume ice. Additionally, while the extension portion prevents the water drainage outlet from being blocked, it may also avoid additional heating wires at the water drainage outlet, thus reducing the cost of the refrigerator.

Further, in the air-cooled refrigerator of the present invention, the front plate segment may abut against the first oblique portion, the middle plate segment obliquely extends upwards from the rear end of the front plate segment, and the rear plate segment obliquely extends upwards from the rear end of the middle plate segment. When the evaporator is provided on the middle plate segment, it may be completely enclosed with the front plate segment, the middle plate segment and the rear plate segment to collect the defrosting water on the evaporator to the greatest extent.

Further, in the air-cooled refrigerator of the present invention, the parallel sections of the heating wire are parallelly provided at the bottom of the evaporator at intervals in the transverse direction, and the heating wire is coiled in an S shape under the connection of the connection sections, such that the length of the heating wire is increased while the evaporator may be evenly heated. Additionally, the expansion section of the heating wire extends towards the two sides to conduct defrosting heating on the region in front of the evaporator, which makes the action region of the heating wire more comprehensive and further guarantees smooth defrosting and water drainage.

These and other objectives, advantages and features of the present invention will be better understood by those skilled in the art in the light of the detailed description of specific embodiments of the present invention in conjunction with the accompanying drawings below.

BRIEF DESCRIPTION OF THE DRAWINGS

Some specific embodiments of the present invention will be described below in detail in an exemplary and non-limiting manner with reference to the accompanying drawings. Identical reference numerals in the accompanying drawings indicate identical or similar components or parts. It should be understood by those skilled in the art that these accompanying drawings are not necessarily drawn to scale. In the accompanying drawings.

DETAILED DESCRIPTION

In the description of the embodiment, it should be understood that, orientation or position relationships indicated by terms "longitudinal," "transverse," "length," "width," "thickness," "upper," "lower," "front," "rear," "left," "right," "vertical," "horizontal," "top," "bottom," "depth," etc. are based on orientations of a refrigerator in normal use as a reference, and can be determined with reference to orientation or position relationships as shown in accompanying drawings. For example, "front" for indicating an orientation refers to a side of the refrigerator facing towards a user. It is merely for ease of describing the present invention and simplifying the description, and not for indicating or implying the device or component referred to should have a specific orientation and be constructed and operated in the specific orientation, and thus it cannot be interpreted as the limitation on the present invention.

Figure 1:
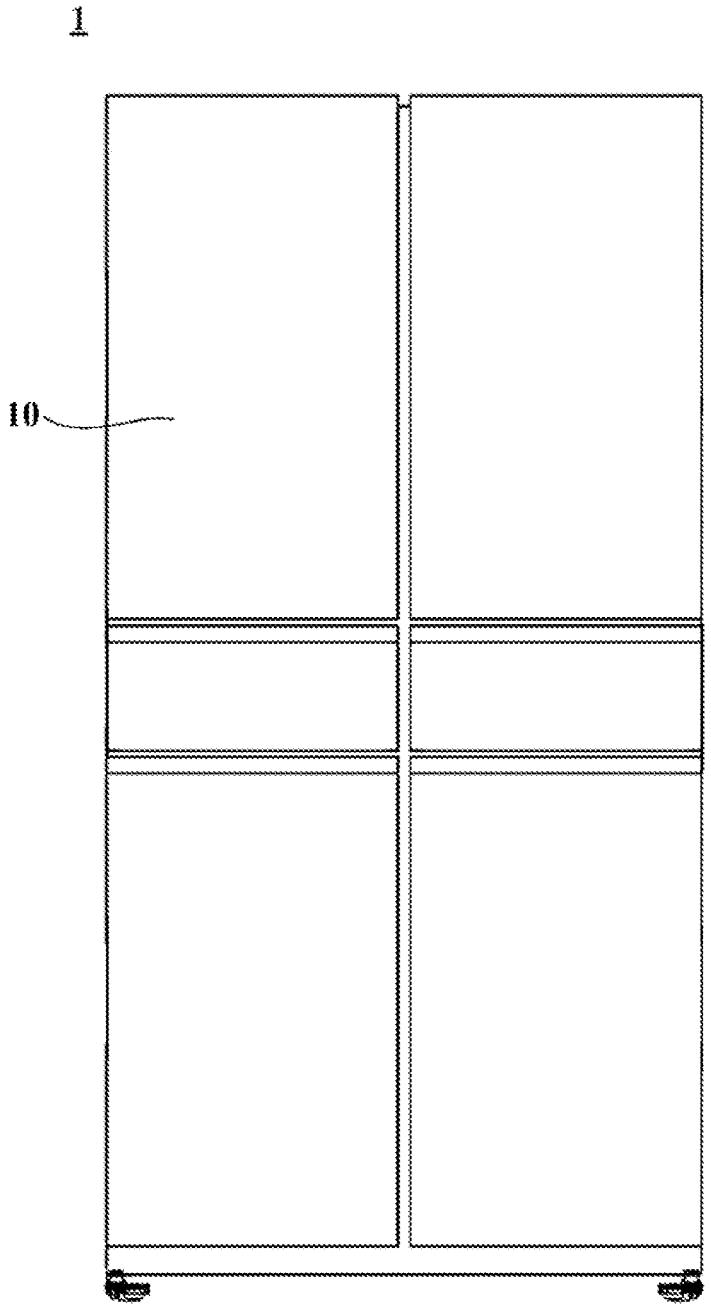
FIG. 1 is a schematic diagram of a refrigerator according to an embodiment of the present invention.

See FIG. 1, a refrigerator 1 of the embodiment may generally include a refrigerator body 10. The refrigerator body 10 may include a housing, a liner, a heat insulation layer and other accessories. The housing is an outer layer structure of the refrigerator 1, and protects the whole refrigerator 1. In order to isolate heat conduction from the outside, the heat insulation layer is added between the housing and the liner of the refrigerator body 10, and the heat insulation layer is generally made by means of a foaming process. There may be one or more liners, which may be arbitrarily divided into a refrigerating liner, a variable temperature liner, a freezing liner and the like according to functions. The specific number and functions of the liners may be configured according to usage demands of the refrigerator. In the embodiment, the liner at least includes a bottom liner 100, which may generally be a freezing liner.

Figure 2:
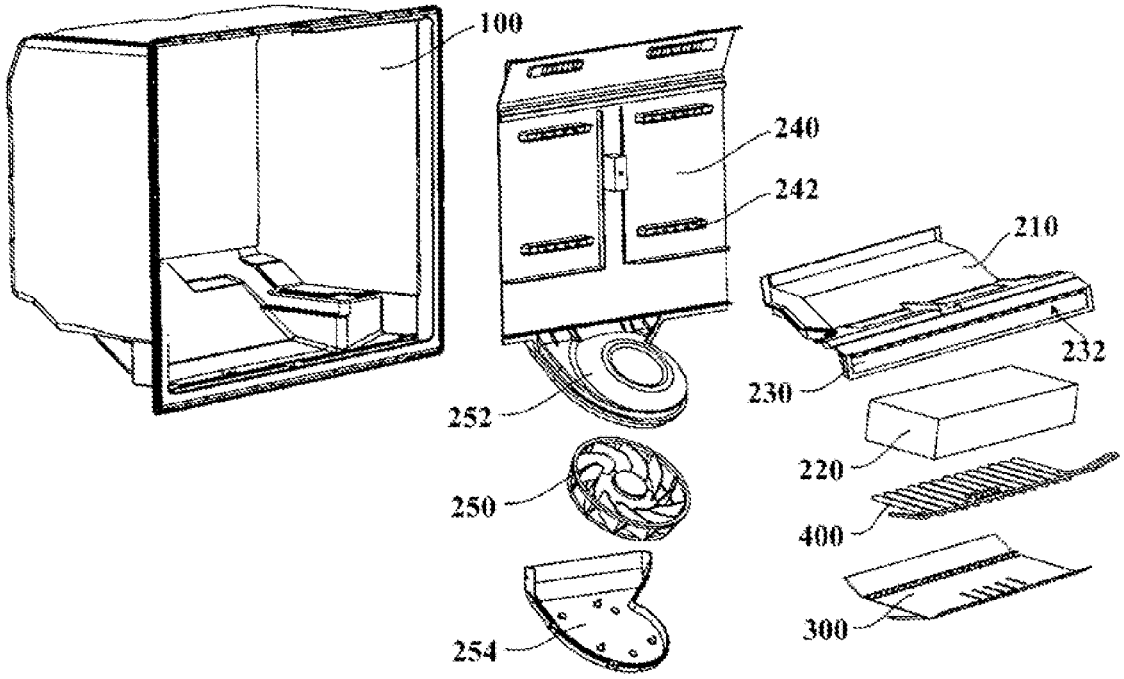
FIG. 2 is an exploded view of a refrigerator according to an embodiment of the present invention, with a housing being hidden.
Figure 3:
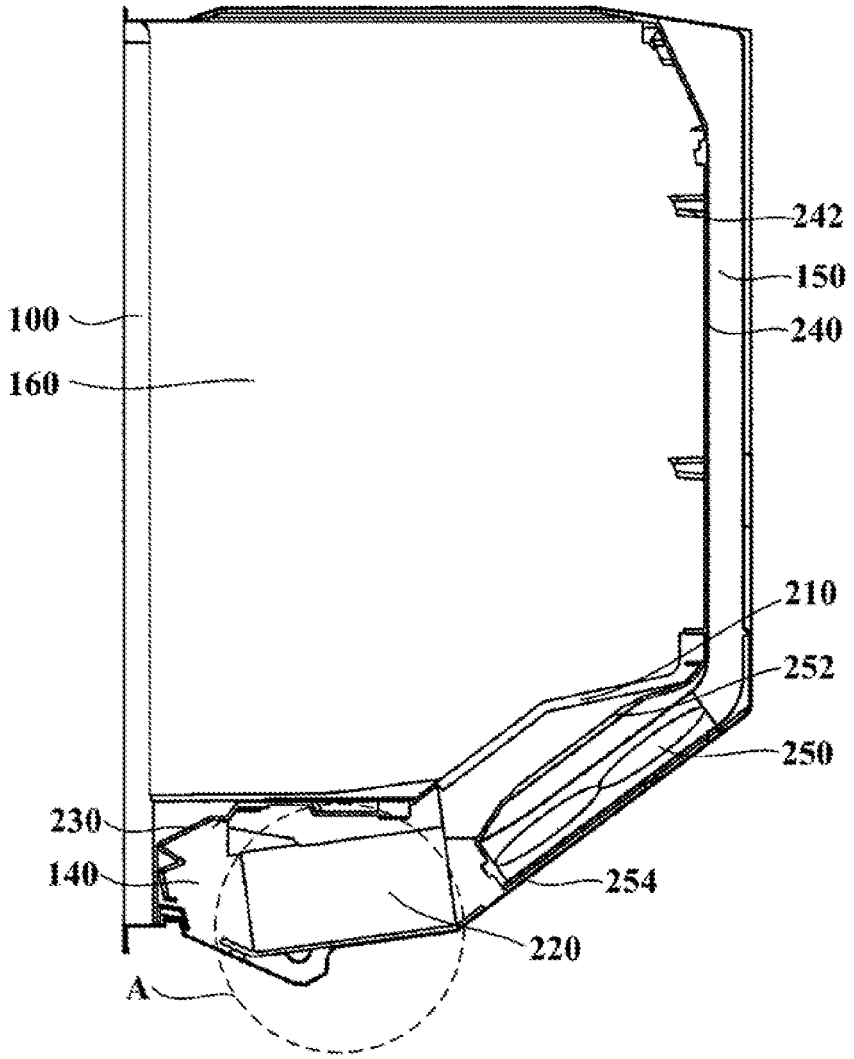
FIG. 3 is a sectional view of a refrigerator according to an embodiment of the present invention, with a housing being hidden.

See FIGS. 2 and 3, a cooling chamber 140 is provided at the bottom of the bottom liner 100 of the refrigerator 1 of the embodiment, and an evaporator 220 is provided inside the cooling chamber 140 and supplies cold to the refrigerator 1. Specifically, a separation cover plate 210 is provided on the lower portion of the bottom liner 100, and transversely provided inside the bottom liner 100 to separate the bottom liner 100 into the cooling chamber 140 and a freezing compartment 160 located above the cooling chamber 140.

That is, the evaporator 220 in the embodiment is provided on the lower portion of the bottom liner 100. Such a manner may avoid the reduction of depth of the freezing compartment due to the occupation of a rear space of the freezing compartment by an evaporator in a traditional refrigerator. Especially for a side-by-side refrigerator, it is especially important to increase the depth dimension of the freezing compartment when its transverse dimension is small. Thus, the space utilization of the refrigerator 1 is improved, and objects that are large and difficult to be divided are stored advantageously.

Additionally, in the traditional refrigerator, the freezing compartment on the lowest portion has a low position, a user needs to bend down significantly or squat down to pick up and place objects in the freezing compartment. Thus, it is inconvenient for the user to use, especially for the elderly. However, in the embodiment, the lower space of the bottom liner 100 is occupied by the cooling chamber 140, and thus the height of the freezing compartment 160 above the cooling chamber 140 is raised, which reduces the degree of bending down when the user picks up and places the objects in the freezing compartment 160, thereby improving the user experience of the user.

See FIG. 3, in the embodiment, the evaporator 220 is arranged on the front portion of the cooling chamber 140, and obliquely provided in the cooling chamber 140. This mode breaks through the technical shackle that, in the prior art, an evaporator needs to be placed horizontally to reduce the depth dimension. Although oblique placement of the flat cuboid evaporator 220 may increase a length in the front-back direction, it makes other components inside the cooling chamber 140 arranged more reasonably, and it is verified from actual analysis of an air flow field that air circulation efficiency is higher, and water drainage is smoother. The layout of oblique placement of the evaporator 220 is one of the main technical improvements made in the embodiment. In some specific embodiments, the inclination angle of the evaporator 220 is set within a range from 7 to 8 degrees, e.g., 7 degrees, 7.5 degrees and 8 degrees, preferably 7.5 degrees.

See FIGS. 2 and 3, in the embodiment, the refrigerator 1 may also include an air supply assembly. The air supply assembly is provided behind the evaporator 220. The air supply assembly may include a centrifugal fan and an air supply duct 150. The centrifugal fan is obliquely provided behind the evaporator 220, with its suction inlet facing towards a front lower portion and its air outlet facing towards a rear portion, and is configured to enable the formation of a refrigeration air flow supplied towards the freezing compartment 160 via the evaporator 220. The air supply duct 150 communicates with the air outlet of the centrifugal fan and extends upwards, and is configured to convey an air flow discharged by the centrifugal fan to the freezing compartment 160. A proportion of a horizontal distance between the front end of the centrifugal fan and the evaporator 220 to the depth dimension of the refrigerator body 10 in the front-back direction is less than 4.5%. For example, the proportion is set to 4.3%.

See FIGS. 2 and 3, the refrigerator 1 may also include an air duct back plate 240. The air duct back plate 240 is provided in front of the rear wall of the bottom liner 100 and may be roughly parallel to the rear wall of the bottom liner 100, so as to define the air supply duct 150 together with the rear wall of the bottom liner 100. The air supply duct 150 communicates with the air outlet of the centrifugal fan and extends upwards. At least one air supply outlet 242 is formed in the air duct back plate 240. The air supply outlet 242 is configured to make the air supply duct 150 communicate with the freezing compartment 160. The air supply duct 150 communicates with the cooling chamber 140, and the separation cover plate 210 serves as a separation portion of the cooling chamber 140, thus the air duct back plate 240 may be connected with separation cover plate 210 in an abutting manner, so as to play a role in sealing a gap between the cooling chamber 140 and the air supply duct 150. In some preferable embodiments, the refrigeration fan may also be a centrifugal fan.

See FIGS. 2 and 3, the refrigeration fan may also include fan blades 250, a fan upper cover 252 and a fan bottom shell 254. The fan upper cover 252 obliquely extends downwards from the lower end of the air duct back plate 240 into the cooling chamber 140. The fan bottom shell 254 covers the fan upper cover 252 and is fastened thereto. The fan blades 250 are provided inside a fan cavity (not shown in the figures) formed by the fan upper cover 252 and the fan bottom shell 254. The air duct back plate 240 and the fan upper cover 252 may also be configured as an integrally-formed piece, so as to simplify installation processes and reduce costs, and also enable the whole air duct structure to be more stable.

See FIGS. 2 and 3, the refrigerator 1 may also include a return air cover 230. The return air cover 230 is provided on the front portion of the cooling chamber 140. At least one front return air inlet 232 that makes the cooling chamber 140 communicate with the freezing compartment 160 is formed in the return air cover 230.

The evaporator 220 inside the cooling chamber 140 conducts heat exchange with surrounding air, to reduce the temperature of the air to form a refrigeration air flow. With the promotion of the centrifugal fan, the refrigeration air flow is discharged from the cooling chamber 140 to the air supply duct 150, and then enters the freezing compartment 160 from the air supply outlet 242 in the air duct back plate 240, so as to conduct heat exchange with air in the freezing compartment 160 to reduce the temperature of the freezing compartment 160. The refrigeration air flow may flow back to the cooling chamber 140 via the front return air inlet 232 in the return air cover 230 after heat exchange to continue to conduct heat exchange with the evaporator 220, thereby forming a circulating air flow path.

See FIGS. 2 to 5, in the embodiment, a water receiving tank 1241 is formed on the bottom wall of the bottom liner 100, and a water drainage outlet 1241*a* is formed at the bottom of the water receiving tank 1241; the evaporator 1 also includes a water receiving tray 300 and a heating wire 400; the water receiving tray 300 is provided between the evaporator 220 and the bottom wall of the bottom liner 100, and is configured to receive water on the evaporator 220, and a plurality of through holes 322 are formed in a region of the water receiving tray 300 facing towards the water receiving tank 1241; the heating wire 400 is provided between the water receiving tray 300 and the evaporator 220 in a coiled manner, and is configured to provide heat for defrosting of the evaporator 220, and the heating wire 400 has an extension portion 412 extending to the water receiving tank 1241 through the through holes 322.

In a using process of the refrigerator 1, since the temperature of the evaporator 220 is lower than the outside temperature, water vapor in outside air may be condensed by the evaporator 220 and then frosted onto the surface of the evaporator 220, which is prone to affecting the refrigeration effect and efficiency of the refrigerator and even causes a quality fault.

The heating wire 400 is provided between the water receiving tray 300 and the evaporator 200 in the coiled manner, and may heat the evaporator 220 at intervals according to certain parameters to melt frost on the evaporator 220. For instance, when a compressor of the refrigerator 1 starts to work, the temperature of the evaporator 220 is reduced, a large amount of condensed water or defrosting water is produced at this time, and the heating wire 400 is started to conduct defrosting. Of course, starting and stopping of the heating wire 400 may also be controlled by other control logics, and in order not to obscure the invention point of the invention, it will not be described in detail herein.

The water receiving tray 300 is provided between the evaporator 220 and the bottom wall of the bottom liner 100. After the defrost on the evaporator 220 is melted by the heating wire 400, the water receiving tray 300 may receive and collect the defrosting water, and divert the defrosting water into the water receiving tank 1241 on the bottom wall of the bottom liner 100. The water drainage outlet 1241*a* is formed at the bottom of the water receiving tank 1241. The water drainage outlet 1241*a* may generally communicate the water receiving tank 1241 with a compressor compartment located below the rear side of the bottom liner 100 to evaporate the defrosting water in the compressor compartment, thus preventing the defrosting water from dripping onto other components of the refrigerator 1 and causing a fault.

The water drainage outlet 1241*a* is located at the bottom of the water receiving tank 1241. The heating wire 400 is provided between the water receiving tray 300 and the evaporator 220. In other words, there is a certain distance between the water drainage outlet 1241*a* and the heating wire 400, and there is also the water receiving tray 300 spaced between them, which may cause the situation that some large-volume ice cannot be melted by the heating wire 400 in time when falling in the water drainage outlet 1241*a*, resulting in blocking of the water drainage outlet 1241*a* and disadvantageous water drainage.

Thus, in order to overcome the above defects, in the refrigerator of the embodiment, the plurality of through holes 322 are formed in the region of the water receiving tray 300 facing towards the water receiving tank 1241, and the heating wire 400 has the extension portion 412 extending to the water receiving tank 1241 through the through holes 322. At least part of the extension portion 412 is provided in the water receiving tank 1241, which may reduce the distance between the heating wire 400 and the water drainage outlet 1241*a* so that heat of the heating wire 400 can be transferred to the water drainage outlet 1241*a* in time to prevent the water drainage outlet 1241*a* from being blocked. Additionally, since the heating wire 400 is provided between the water receiving tray 300 and the evaporator 220, the extension portion 412 may define the position between the water receiving tray 300 and the heating wire 400 when extending to the water receiving tank 1241 through the through holes 322.

Additionally, while the extension portion prevents the water drainage outlet from being blocked, it may also avoid additional heating wires at the water drainage outlet, thus reducing the cost of the refrigerator.

In some specific embodiments of the present invention, the extension portion 412 may be formed by bending the middle of the heating wire 400 towards the water receiving tray 300. The diameter of the heating wire 400 may be slightly smaller than the dimensions of the through holes 322 to allow the extension portion 412 to pass through the through holes 322. For example, the diameter of the heating wire 400 may be 4.5 mm, and the widths of the through holes 322 may be 6 mm, etc., which will not be enumerated herein.

The heating wire 400 may also be configured as an aluminum tube heating wire. The water receiving tray 300 may also be configured as an aluminum water receiving tray. The aluminum water receiving tray 300 mainly acts to effectively and quickly transfer the heat of the heating wire 400 to all portions of the evaporator 220 to increase the heating area of the evaporator 220, thereby improving the defrosting efficiency.

In some specific embodiments of the present invention, the distance between the bottom end of the extension portion 412 and the water drainage outlet 1241*a* may also be configured as any numerical value within a range from 3 mm to 5 mm, e.g., 3 mm, 4 mm or 5 mm, so as to make the extension portion get close to the water drainage outlet 1241*a* to the greatest extent on the premise of not affecting the water drainage effect of the water drainage outlet 1241*a* to prevent the water drainage outlet 1241*a* from being blocked.

Figure 4:
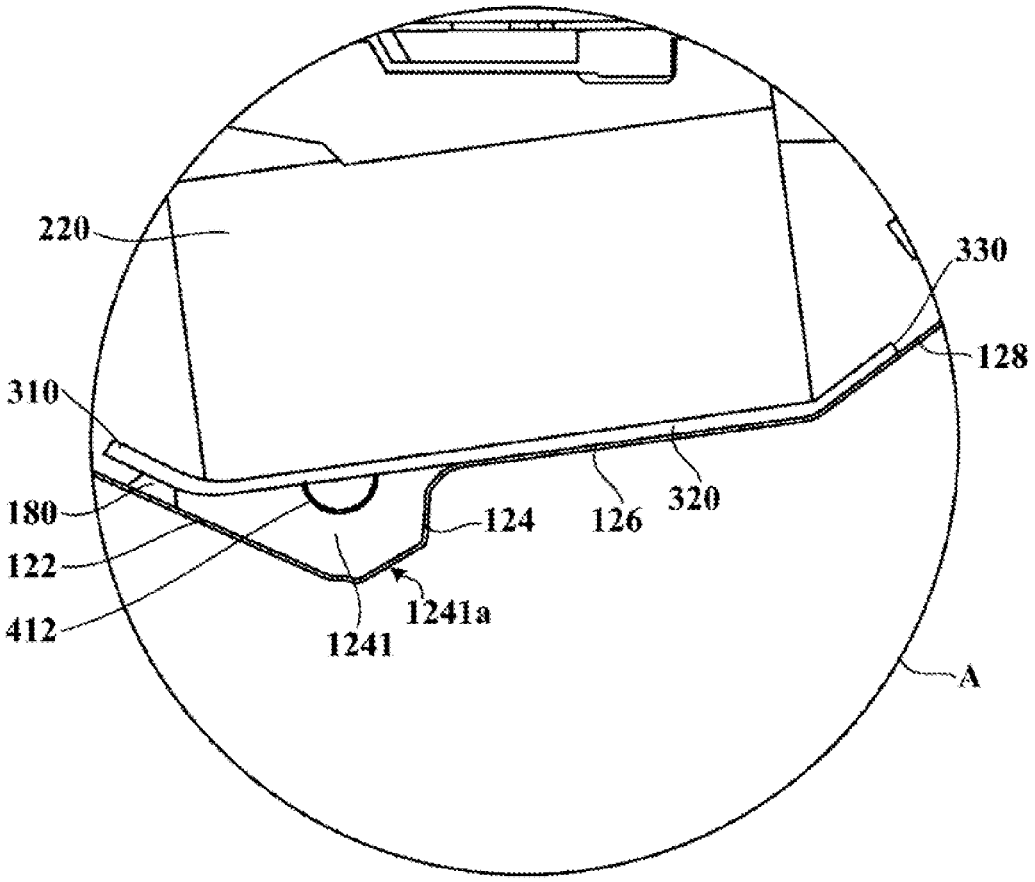
FIG. 4 is an enlarged view of part A in FIG. 3.

See FIGS. 3 and 4, in some embodiments of the present invention, the bottom wall of the bottom liner 100 may include a first oblique portion 122, a sunken portion 124, a second oblique portion 126 and a third oblique portion 128. The first oblique portion 122 is obliquely provided downwards from front to back from the front end of the bottom wall of the bottom liner 100. The sunken portion 124 is provided on the rear side of the first oblique portion 122, and is configured to incline upwards from a transverse middle to two sides to form the water receiving tank 1241 in the transverse middle. The second oblique portion 126 is obliquely provided upwards from front to back from the rear end of the water receiving tank 1241. The third oblique portion 128 is obliquely provided upwards from front to back from the rear end of the second oblique portion 126.

In the embodiment, the second oblique portion 126 is obliquely provided relative to the front end of the bottom wall of the bottom liner 100. The evaporator 220 may be directly or indirectly provided on the second oblique portion 126, and the water receiving tank 1241 is formed at the sunken portion 124 located on the lower side of the second oblique portion 126, which enables the defrosting water on the evaporator 220 to be smoothly discharged into the water receiving tank 1241 when the evaporator 220 is obliquely provided on the second oblique portion 126.

In some specific embodiments, the inclination angle of the third oblique portion 128 is greater than that of the second oblique portion 126, and the inclination angle of the third oblique portion 128 relative to the horizontal direction may also be set within a range from 36 to 37 degrees, e.g., 36 degrees, 36.5 degrees and 37 degrees, preferably 36.7 degrees.

Figure 5:
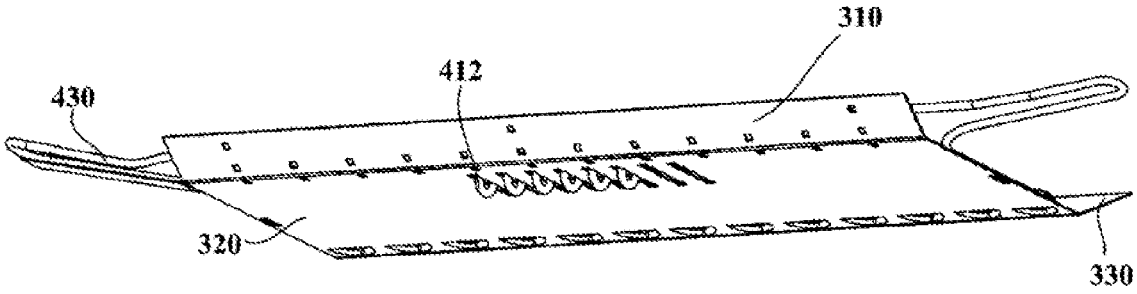
FIG. 5 is a schematic diagram of an installation relationship between a water receiving tray and a heating wire in a refrigerator according to an embodiment of the present invention.
Figure 6:
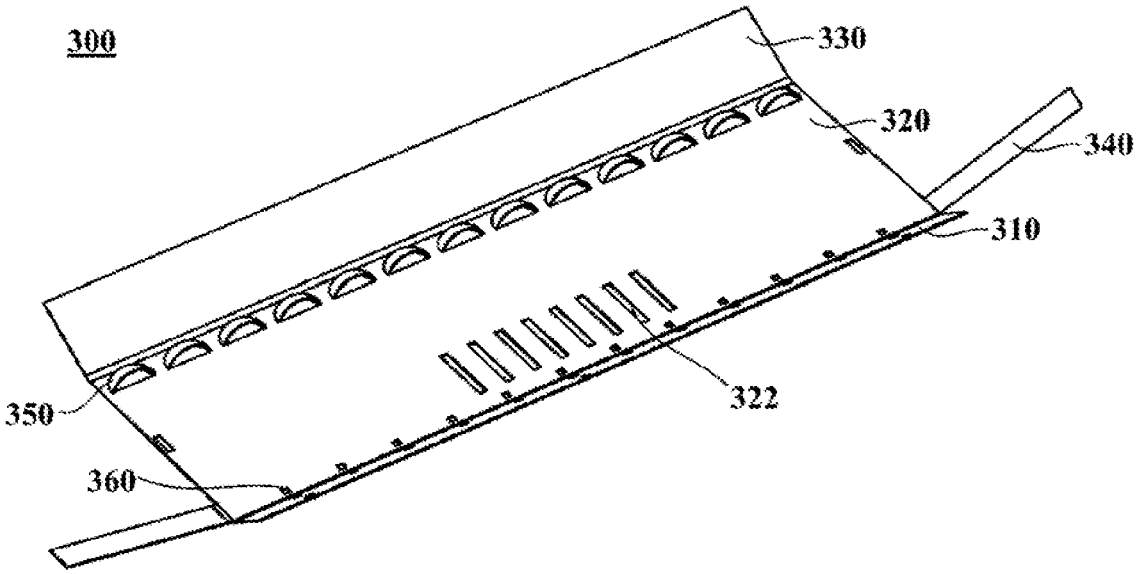
FIG. 6 is a schematic diagram of a water receiving tray in a refrigerator according to an embodiment of the present invention.

See FIGS. 4 to 6, in some embodiments of the present invention, the water receiving tray 300 includes a front plate segment 310, a middle plate segment 320 and a rear plate segment 330. The front plate segment 310 is located at the front end of the water receiving tray 300, and a gap is formed between it and the first oblique portion 122; the middle plate segment 320 obliquely extends upwards from the rear end of the front plate segment 310, with its front portion being located above the water receiving tank 1241 and provided with the plurality of through holes 322 and its rear portion abutting against the second oblique portion 126; and the rear plate segment 330 obliquely extends upwards from the rear end of the middle plate segment 320 and abuts against the third oblique portion 128.

The evaporator 220 has an overall flat cuboid shape, and is provided on the middle plate segment 320, and the bottom of a front end of the evaporator abuts against the junction of the middle plate segment 320 and the front plate segment 310, such that the evaporator 220 is provided at the inclination angle of the second oblique portion 126 to achieve the technical effect of oblique provision of the evaporator 220 in the above embodiments.

In the embodiment, the front plate segment 310 may abut against the first oblique portion 122, the middle plate segment 320 obliquely extends upwards from the rear end of the front plate segment 310, and the rear plate segment 330 obliquely extends upwards from the rear end of the middle plate segment 320. When the evaporator 220 is provided on the middle plate segment 320, it may be completely enclosed by the front plate segment 310, the middle plate segment 320 and the rear plate segment 330 to collect the defrosting water on the evaporator 220 to the greatest extent.

Further, in the embodiment, the evaporator 220 is provided on the middle plate segment 320, and the middle plate segment 320 obliquely extends upwards from the rear end of the front plate segment 310, with its front end being located above the water receiving tank 1241. In other words, the front end of the evaporator 220 is also inclined towards the water receiving tank 1241, which may also reduce the distance between the front portion of the evaporator 220 and the water receiving tank 1241, thus reducing the distance between the whole heating wire 400 and the water receiving tank 1241. In the present invention, it is precisely because of the cooperation of the modes of the extension portion 412 and oblique provision of the evaporator 220 that the distance between the heating wire 400 and the water receiving tank 1241 is reduced to heat the water drainage outlet 1241*a*.

See FIG. 4, the first oblique portion 122 may also form a protrusion portion 180, and the front plate segment 310 may lean against the protrusion portion, such that a gap is formed between the front plate segment 310 and the first oblique portion 122. The gap enables the water receiving tank 1241 to communicate with the cooling chamber 140 to keep the pressure of the water receiving tank 1241 equal to that of the cooling chamber 140, which is beneficial to water drainage.

In some specific embodiments, the distance between the front plate segment 310 and the first oblique portion 122 may also be configured as any numerical value within a range from 20 mm to 45 mm, e.g., 20 mm, 30 mm or 45 mm.

Figure 7:
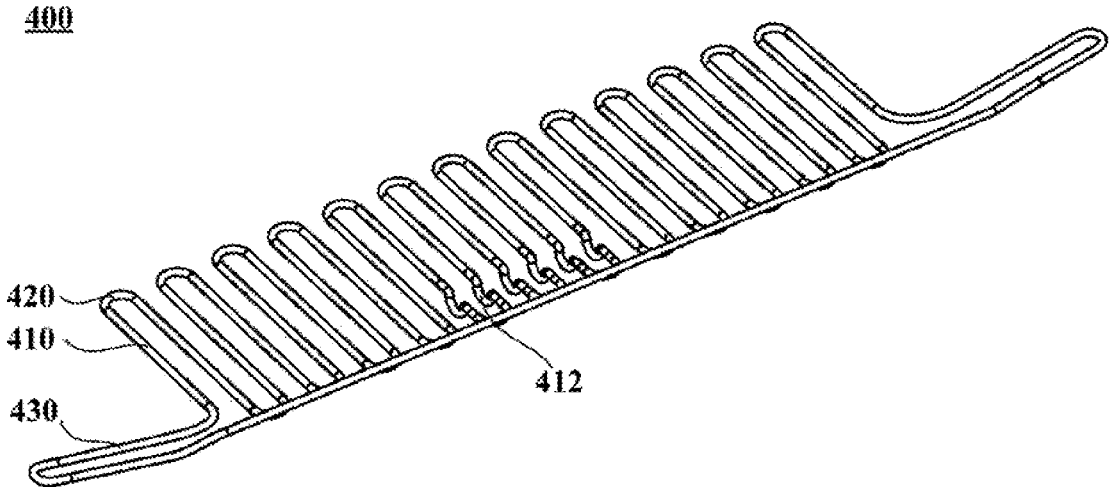
FIG. 7 is a schematic diagram of a heating wire in a refrigerator according to an embodiment of the present invention.

See FIGS. 2 and 7, in some embodiments of the present invention, the heating wire 400 includes a plurality of parallel sections 410 and a plurality of connection sections 420. The plurality of parallel sections 410 are parallelly provided at intervals relative to the transverse direction of the refrigerator 1, and the extension portion 412 is formed on the parallel sections 410. Each connection section 420 is provided between the ends on a same side of adjacent two parallel sections 410 in a bent extension manner to sequentially connect the plurality of parallel sections 410 in series.

That is, the heating wire 400 in the embodiment is provided in a manner of being coiled in an S shape, and the number of the parallel sections 410 and the distance between every two adjacent parallel sections 410 may be configured according to the area of the evaporator 220, such that the evaporator 220 may be evenly heated. The extension portion 412 may be formed by downwards bending the parallel sections 410, so as to protrude from the surface of the heating wire 400 and extend downwards to heat the water drainage outlet 1241*a*.

See FIGS. 6 and 7, the heating wire 400 may also include an expansion section 430. A middle portion of the expansion section 430 is provided abutting against the front plate segment 310 and the expansion section extends towards two sides to a position close to a side wall of the bottom liner 100 to conduct defrosting heating on a region in front of the evaporator 220. Ice falling from the top of the evaporator 220 in the defrosting process and ice appearing at a side return air inlet are melted and removed, which makes the action region of the heating wire more comprehensive and further guarantees smooth defrosting and water drainage.

Correspondingly, the side portions of the water receiving tray 300 may also extend towards the two sides to form expansion plate segments 340 to bear the expansion section 430.

See FIG. 6, in some embodiments of the present invention, a plurality of limiting parts 350 are provided on the positions of the rear portion of the upper surface of the middle plate segment 320 facing towards the plurality of connection sections 420 to limit the connection sections 420.

In the embodiment, the limiting parts 350 may be a plurality of clamping grooves arched from the upper surface of the middle plate segment 320, and the connection sections 420 on the same side may extend into the clamping grooves, so as to limit the heating wire 400 and the middle plate segment 320 to simplify assembly processes. In some preferable embodiments, the limiting parts 350 have a shape of semisphere, which minimizes the impact on the refrigeration air flow.

See FIG. 6, a plurality of water drainage holes 360 are also formed in the front portion of the upper surface of the middle plate segment 320 to discharge water received by the water receiving tray 300 into the water receiving tank 1241 through the water drainage holes 360 and gaps between the through holes 322 and the extension portion 412.

At this point, it should be recognized by those skilled in the art that, although multiple exemplary embodiments of the present invention have been exhaustively shown and described herein, many other variations or modifications in accordance with the principles of the present invention may still be directly determined or derived from the disclosure of the present invention without departing from the spirit and scope of the present invention. Therefore, the scope of the present invention should be understood and recognized as covering all these other variations or modifications.

What is claimed is:

1. An air-cooled refrigerator, comprising:

a bottom liner, internally defining a cooling chamber located at its bottom, a water receiving tank being formed on a bottom wall of the bottom liner, and a water drainage outlet being formed at a bottom of the water receiving tank;

an evaporator, provided inside the cooling chamber, and configured to cool an air flow entering the cooling chamber to form a cooled air flow;

a water receiving tray, provided between the evaporator and the bottom wall of the bottom liner, and configured to receive water on the evaporator, a plurality of through holes being formed in a region of the water receiving tray facing towards the water receiving tank; and a heating wire, provided between the water receiving tray and the evaporator in a coiled manner, and configured to provide heat for defrosting of the evaporator, the heating wire having an extension portion extending to the water receiving tank through the through holes.

2. The air-cooled refrigerator according to claim 1, wherein the bottom wall of the bottom liner comprises:

a first oblique portion, obliquely provided downwards from front to back from a front end of the bottom wall of the bottom liner;

a sunken portion, provided on a rear side of the first oblique portion, and configured to be inclined upwards from a transverse middle to two sides to form the water receiving tank in the transverse middle;

a second oblique portion, obliquely provided upwards from front to back from a rear end of the water receiving tank; and a third oblique portion, obliquely provided upwards from front to back from a rear end of the second oblique portion; and an inclination angle of the third oblique portion is greater than that of the second oblique portion.

3. The air-cooled refrigerator according to claim 2, wherein the water receiving tray comprises:

a front plate segment, located at a front end of the water receiving tray, with a gap being formed between it and the first oblique portion;

a middle plate segment, obliquely extending upwards from a rear end of the front plate segment, with its front portion being located above the water receiving tank and provided with the plurality of through holes and its rear portion abutting against the second oblique portion; and a rear plate segment, obliquely extending upwards from a rear end of the middle plate segment, and abutting against the third oblique portion.

4. The air-cooled refrigerator according to claim 3, wherein the evaporator has an overall flat cuboid shape, and is provided on the middle plate segment, and a bottom of a front end of the evaporator abuts against a junction of the middle plate segment and the front plate segment, such that the evaporator is provided at the inclination angle of the second oblique portion.

5. The air-cooled refrigerator according to claim 3, wherein a distance between the front plate segment and the first oblique portion is configured as any numerical value within a range from 20 mm to 45 mm.

6. The air-cooled refrigerator according to claim 3, wherein the heating wire comprises:

a plurality of parallel sections, parallelly provided at intervals relative to a transverse direction of the refrigerator, the extension portion being formed on the parallel sections; and a plurality of connection sections, each connection section being provided between ends on a same side of adjacent two parallel sections in a bent extension manner to sequentially connect the plurality of parallel sections in series.

7. The air-cooled refrigerator according to claim 6, wherein the heating wire further comprises:

an expansion section, a middle portion of the expansion section being provided abutting against the front plate segment and the expansion section extending towards two sides to a position close to a side wall of the bottom liner to conduct defrosting heating on a region in front of the evaporator.

8. The air-cooled refrigerator according to claim 6, wherein a plurality of limiting parts are provided on positions of a rear portion of an upper surface of the middle plate segment facing towards the plurality of connection sections to limit the connection sections.

9. The air-cooled refrigerator according to claim 3, wherein a plurality of water drainage holes are further formed in a front portion of the upper surface of the middle plate segment to discharge water received by the water receiving tray into the water receiving tank through the water drainage holes and gaps between the through holes and the extension portion.

10. The air-cooled refrigerator according to claim 1, wherein a distance between a bottom end of the extension portion and the water drainage outlet is configured as any numerical value within a range from 3 mm to 5 mm.

* * * * *